US006925352B2

(12) United States Patent
Wu et al.

(10) Patent No.: US 6,925,352 B2
(45) Date of Patent: Aug. 2, 2005

(54) METHOD AND SYSTEM FOR PREDICTION OF PRECIPITATION KINETICS IN PRECIPITATION-HARDENABLE ALUMINUM ALLOYS

(75) Inventors: Xijia Wu, Ottawa (CA); Cheung J. Poon, Gloucester (CA); Donald Raizenne, Kanata (CA)

(73) Assignee: National Research Council of Canada, Ottawa (CA)

( * ) Notice: Subject to any disclaimer, the term of this patent is extended or adjusted under 35 U.S.C. 154(b) by 785 days.

(21) Appl. No.: 09/931,096

(22) Filed: Aug. 17, 2001

(65) Prior Publication Data

US 2003/0045963 A1 Mar. 6, 2003

(51) Int. Cl.[7] ..... G06F 19/00

(52) U.S. Cl. ..... 700/147; 700/153; 700/117; 148/112

(58) Field of Search ..... 700/95, 100, 117, 700/299, 145, 153, 147; 148/112, 121, 559, 508, 511, 523, 549; 75/10.21

(56) References Cited

U.S. PATENT DOCUMENTS

| | | | | |
|---|---|---|---|---|
| 4,358,324 A | | 11/1982 | Mahoney et al. | |
| 5,054,314 A | | 10/1991 | Cofflard et al. | |
| 5,108,520 A | | 4/1992 | Liu et al. | |
| 5,306,359 A | * | 4/1994 | Eppeland et al. | 148/511 |
| 5,650,026 A | * | 7/1997 | Ganyo et al. | 148/511 |
| 5,858,134 A | | 1/1999 | Bechet et al. | |
| 6,197,130 B1 | * | 3/2001 | Cantrell et al. | 148/508 |
| 6,350,326 B1 | * | 2/2002 | McCay et al. | 148/503 |
| 6,571,615 B1 | | 6/2003 | Meyer et al. | |

FOREIGN PATENT DOCUMENTS

| | | |
|---|---|---|
| JP | 59-226197 | 12/1984 |
| WO | WO 01/48259 | 7/2001 |

OTHER PUBLICATIONS

Rohrer et al., "A Kinetic Model of Precipitate Evolution", Mat. Res. Soc. Symp. Proc., vol. 398, Materials Research Society, Nov. 1996.

Sobh et al., "Quench Process Modeling and Optimization", Materials Processing in the Computer Age III, pp. 3–14, The Minerals, Metals & Materials Society, 2000.

Wu et al., "A New Approach to Heat Damage Evaluation for 7xxx Aluminum Alloy" Can. Aeronautics & Space Journal, vol. 42, No. 2, pp. 93–101, Jun. 1996.

Yang et al., "Evolution of Fine Grained Microstructure and Superplasticity in Warm–Worked 7075 Aluminum Alloy", Journal of the Japan Institute of Metals, vol. 59, No. 12, pp. 1222–1229, Dec. 1995.

* cited by examiner

*Primary Examiner*—Leo Picard
*Assistant Examiner*—Alexander Kosowski
(74) *Attorney, Agent, or Firm*—Freedman & Associates

(57) ABSTRACT

Disclosed are a method and a system for predicting precipitation kinetics in precipitation-hardenable alloys, such as the 7000 series aluminum alloys, and for optimizing conditions for thermal treatment thereof. The method includes the steps of measuring a real-time temperature of an alloy component during the thermal treatment process, and using a signal in dependence upon the real-time temperature to predict, using executable code, a current state of the alloy component. The executable code includes a series of rate equations and initial parameters for a particular alloy. Optionally, the initial parameters for the particular alloy are provided after the code is in execution. The thermal treatment process is terminated when a predetermined state of the alloy component is predicted.

16 Claims, 5 Drawing Sheets

METHOD AND SYSTEM FOR PREDICTION OF PRECIPITATION KINETICS IN PRECIPITATION-HARDENABLE ALUMINUM ALLOYS

FIELD OF THE INVENTION

The present invention relates to a method and a system for predicting precipitation kinetics, and more particularly to a method and a system for predicting and controlling precipitation kinetics in precipitation-hardenable aluminum alloys and for providing improved heat treatment conditions in dependence thereof.

BACKGROUND OF THE INVENTION

Precipitation-hardenable alloys such as the 7000 series aluminum alloys, are subjected typically to a series of precisely controlled thermal treatment steps to improve yield strength and corrosion resistance of the alloy. The mechanical and physical properties of the heat-treated alloy depend upon the relative amounts of each of a plurality of different precipitate phases that are formed during the heat treatment process. Often, the amount of each precipitate phase is expressed as a volume fraction. The 7000 series aluminum alloys are conventionally processed in the T6 temper condition (peak age) or T73 temper condition (overage). The T6 alloys usually contain predominantly meta-stable coherent precipitates and have high strength but poor resistance to stress corrosion cracking (SCC). The T73 alloys, on the other hand, contain large amounts of semi-coherent and incoherent precipitates and have good corrosion resistance but with a rather significant reduction in strength relative to that of the T6 alloys.

A treatment known as Retrogression and Reaging (RRA) can be applied to material in a T6 temper condition (solution treatment followed by a 24 hours of artificial aging at 120° C.) to yield material strength levels equivalent to the T6 material while also having corrosion resistance equivalent to the T73 condition. The RRA process consists of two steps: a) retrogression in the range 180–240° C., followed by water-quenching and b) reaging at about 120° C. for 24 hours. The retrogression step a) is a very critical step and must be controlled carefully. At the higher temperatures of 220–240° C. the optimum time for retrogression may be only a few minutes or even seconds, while at the lower temperatures of 180–200° C. the optimum time may be up to 60 minutes. Such a treatment can be used to obtain an optimised combination of strength and corrosion resistance in 7000 series alloys. RRA processing is of particular interest to aircraft operators, as the technology can be effectively applied to address issues of corrosion damage in ageing aircraft. The technology involves short time heat treatment of alloys in the T6 temper, followed by a re-ageing treatment, as result of which SCC resistance equivalent to that of the T73 temper is achieved with no significant penalty in strength relative to that of the T6 temper. Application of RRA to aircraft components, either by bulk treatment or localized heat treatment, requires tight control over the thermal exposure history during processing. Unfortunately, there are no quantitative criteria that can be used to assess the properties of the processed component after it has been processed according to some arbitrary thermal exposure profile. As such, the properties of the alloy component must be determined by post-treatment testing, which testing often is other than practical when dealing with aircraft components. To overcome such disadvantage, a simulation of the precipitation reactions that occur during RRA will be beneficial to optimise the process.

In "Kinetics for . . . Predicting the Effects of Heat Treating Precipitation-Hardenable Aluminum Alloys", *Industrial Heating,* 44(10) 1977 pp. 6–9, J. T. Staley discloses a process which permits quantitative compensation of effects of precipitation on the yield strength of the material during heating and/or during soaking either above or below the recommended temperature. However, said process produces the metal in either the T6 or the T73 temper state after quenching, and does not address the kinetic issues when a combination of strength and corrosion resistance is to be considered.

Therefore, a problem and a challenge to designers is to predict the properties of a material based on any thermal exposure it experiences, which may then be used as criteria for assessing heat exposure effects, including the effects of heat treatments.

OBJECT OF THE INVENTION

It is an object of the instant invention to provide a method for assessing temperature effects on precipitation-hardenable aluminum alloys.

It is another object of the instant invention to provide a method for optimizing the condition of precipitation-hardenable aluminum alloys through heat treatment.

It is still another object of the instant invention to provide a method for evaluating the effect of thermal exposure on precipitation hardenable-aluminum alloy properties.

It is still another object of the instant invention to provide algorithms describing the precipitation age hardening reactions in aluminum alloys, which can be written in the form of computer code and used in either open-loop or closed-loop mode to control the power input to a furnace, oil bath or any other form of heating as used in industrial heat treating operations.

SUMMARY OF THE INVENTION

The instant invention is directed toward a method and a system for providing improved conditions for heat treatment of precipitation-hardenable aluminum alloy components, for instance the high strength 7000 series aluminum alloys, which are the workhorse structural material for military/commercial aircraft. Particular properties of such alloys depend on the alloy precipitation state, which is sensitive to thermal exposure. Likewise, aluminum alloy structures often incur heat damage due to unexpected hot gas leaks from the engine(s) or fires. It is desirable to control the heat treatment of precipitation hardenable alloys such that optimal properties are obtained for a particular intended service. A preferred embodiment of the instant invention is herein described, wherein the precipitation kinetics of 7000 series aluminum alloys is predicted. Of course, the method and system according to the instant invention are thought to be applicable to aluminum alloys, including the 7000 series aluminum alloys, in particular, and to precipitation-hardenable alloys in general.

In accordance with a preferred embodiment of the instant invention, there is provided a method for providing improved heat treatment conditions for a precipitation-hardenable alloy comprising the steps of:

a) affecting the temperature of the alloy to change an amount of a first precipitate phase relative to an amount of a second precipitate phase;

b) sensing an instantaneous temperature of the alloy and providing a signal in dependence thereof;

c) calculating a value indicative of a current precipitate-phase composition of the alloy according to a series of predetermined rate equations and in dependence upon the provided signal;

d) comparing the calculated value to a predetermined threshold value; and, e) affecting the alloy in dependence upon a result of the step of comparing, wherein the predetermined threshold value is characteristic of an alloy having at least one of an indicated yield strength, specific conductivity and corrosion property.

In accordance with another preferred embodiment of the instant invention, there is provided a method for predicting precipitation kinetics in precipitation-hardenable alloys comprising the steps of:

a) providing an initial value in dependence upon first and second inter-convertible precipitate phases of the alloy;

b) providing data indicative of thermal exposure of the alloy;

c) calculating a value according to predetermined rate equations in dependence upon the provided initial value and the provided data;

d) determining a value indicative of a current precipitate phase composition of the alloy in dependence upon the calculated value; and, e) affecting the alloy in dependence upon a result of the step of comparing.

In accordance with yet another preferred embodiment of the instant invention, there is provided a system for predicting precipitation kinetics comprising:

a holder for accommodating a sample of a precipitation-hardenable alloy having first and second inter-convertible precipitate phases;

a temperature controller for affecting the temperature of the sample;

a sensor in communication with the sample for providing a signal in dependence upon a sensed temperature of the sample; and, a processor for executing code thereon to calculate a value in dependence upon the signal, the value indicative of a current precipitate phase composition of the sample, and for comparing the calculated value to a predetermined threshold value.

BRIEF DESCRIPTION OF THE DRAWINGS

Exemplary embodiments of the invention will now be described in conjunction with the following drawings, in which.

DETAILED DESCRIPTION OF THE INVENTION

Figure 1:
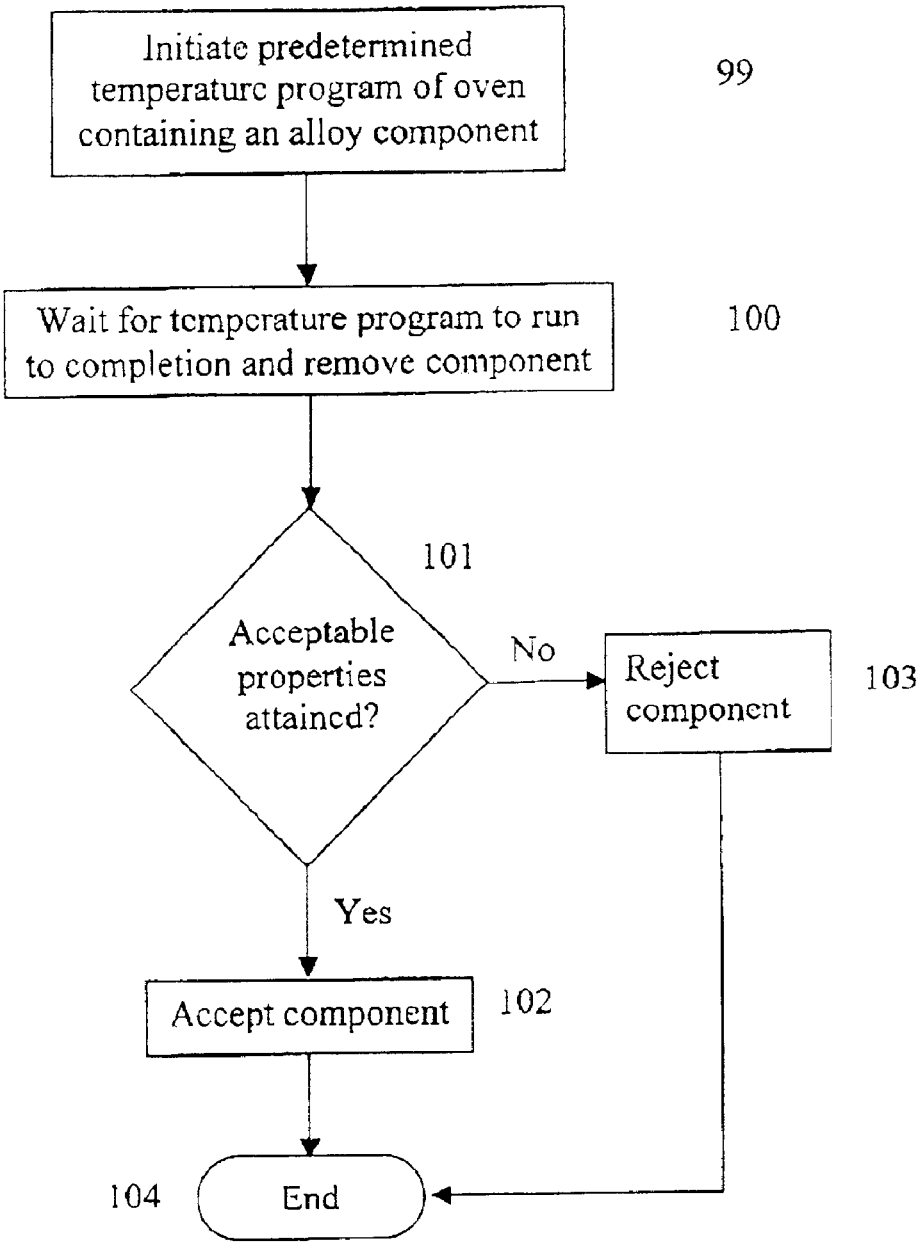
Figure 1 (Prior art)
FIG. 1 shows a simplified flow diagram of a method for thermally treating a precipitation-hardenable aluminum alloy according to the prior art.

Referring to FIG. 1, shown is a method for heat-treating a precipitation-hardenable aluminum alloy component according to the prior art. At step 99 the component is subjected to predetermined temperatures for predetermined periods of time, such as for instance under the control of a preprogrammed temperature program. Typically, a thermocouple is provided to measure the temperature of the atmosphere surrounding the component and to provide a feedback signal in dependence thereof to a heating means. The heating means, such as for instance one of an oven and a furnace, uses the feedback signal to maintain an internal temperature according to the temperature program. Upon completion of the temperature program at step 100 the alloy component is removed from the oven or furnace and cooled. The component is subjected to post-treatment testing at decision step 101 and, when the properties of the component are within other than expected limits, the component is rejected at step 103 and the process is terminated at step 104. When the properties of the component are within expected limits, the component is accepted at step 102 and the process is terminated at step 104. Optionally, a component that is rejected at step 103 is subjected to additional heat treatment cycles and post treatment testing to improve the properties of the component.

It is a limitation of the prior art method of FIG. 1 that the alloy component is assumed to be in thermal equilibrium with a surrounding atmosphere of the oven during the entire period of heat treatment; of course, such is not necessarily the case. For example, convection currents within the oven and/or delays associated with the transfer of heat from the surrounding gas to the alloy component can cause the alloy component to be at a temperature different from that sensed by the thermocouple. Of course, optionally heat is transferred from a medium other than a gas, such as for instance a medium selected from the group including: an oil-bath, a molten salt bath, a woods-metal bath, and a fluidized bed. As such, the alloy component may in practice be subjected to heat treatment conditions that are other than optimal. That said the final properties of the alloy component are difficult to predict absent post-treatment testing, which increases the cost of the acceptable products.

Figure 2A:
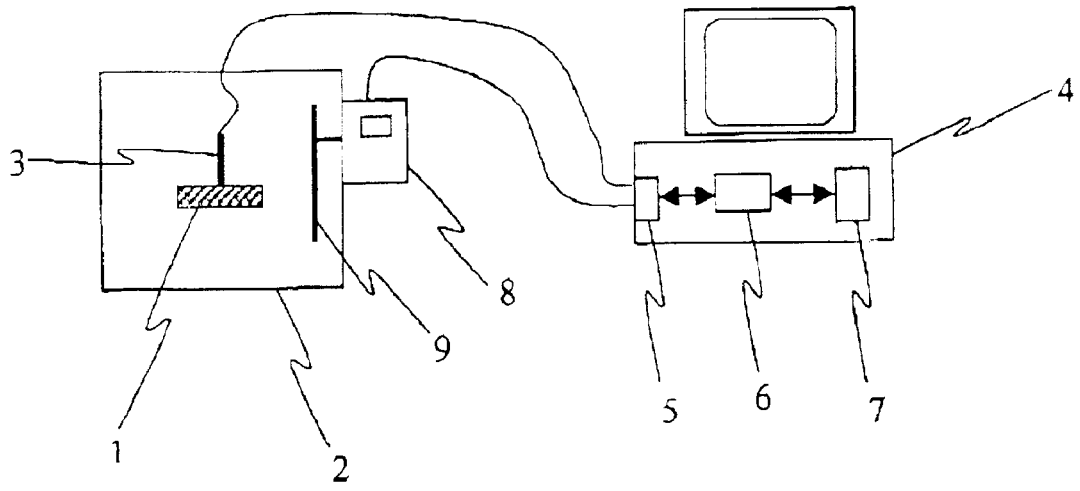
FIG. 2*a* shows a system for optimizing the heat treatment conditions of a precipitation-hardenable aluminum alloy according to a first preferred embodiment of the instant invention.

Referring to FIG. 2*a,* shown is a system for optimizing the conditions of heat treatment of a precipitation-hardenable aluminum alloy according to a first preferred embodiment of the instant invention. In use, a sample 1, such as for instance a component fabricated from a 7000 series aluminum alloy, is exposed to heat. For instance, the sample 1 is placed inside an oven 2. The oven 2 is preferably controlled by a temperature controller 8, which provides power to a heating element 9 according to a pre-programmed temperature program. A thermocouple 3 is provided for sensing, in real-time, the temperature of the sample 1 and for providing a signal in dependence upon the sensed temperature to a processor 6 of a process controller, such as for instance a personal computer 4, via an input/output port 5. Preferably, the thermocouple 3 is in direct thermal communication with the sample 1, such that in use the actual temperature of the sample 1 is sensed. The processor 6 is also in communication with a memory storage area 7. Optionally, means for affecting the temperature of the sample 1 other than the oven 2 is used. Further optionally, the composition of atmosphere surrounding the sample 1 is controllable, for instance the oven 2 includes a means for flowing an inert gas therethrough such as to prevent unwanted reactions occurring at the surface of the alloy being treated therein.

Advantageously, the thermocouple 3 is used to sense, in real-time, the actual temperature of the sample 1 and not that of the surrounding atmosphere of the oven 2; as such, errors associated with heat transfer to the sample 1 are obviated. Further, the temperature program is dynamically modifiable by the processor 6 in dependence upon signals provided by the thermocouple 3, the processor 6 having code for predicting the phase composition of the alloy in execution thereon. The code utilizes a series of predetermined rate equations and initial conditions to process the real-time temperature data and to predict the instantaneous precipitation state of the alloy. The processor 6 is also in communication with the memory storage area 7 for storing calculated phase composition data therein. In basic terms, the calculated volume fraction of each phase within the alloy component is updated in an iterative fashion at predetermined time intervals during the thermal treatment of the component. When a predetermined phrase composition is predicted, the processor 6 terminates immediately the heat treatment. Optionally, the processor 6 terminates a current step of the heat treatment process and initiates a second temperature program to modify further the alloy composition. Further optionally, the alloy composition is expressed using other than a volume fraction.

Figure 2B:
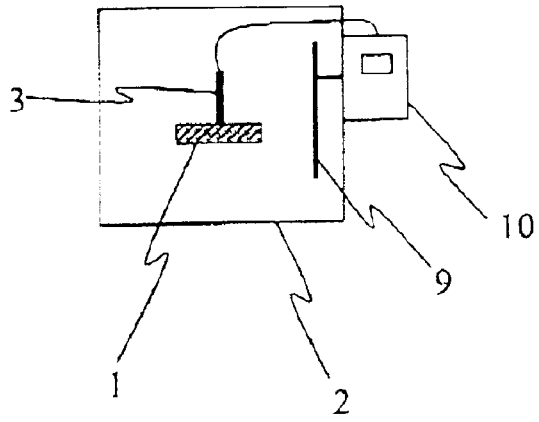
FIG. 2*b* shows a system for optimizing the heat treatment conditions of a precipitation-hardenable aluminum alloy according to a second preferred embodiment of the instant invention.

Referring to FIG. 2*b,* shown is a system for optimizing the conditions of heat treatment of a precipitation-hardenable aluminum alloy according to a second preferred embodiment of the instant invention. Drawing elements identical to those previously described with reference to FIG. 2*a* are assigned like reference numerals in FIG. 2*b.* In the second preferred embodiment, an integrated process controller and temperature controller 10 replaces the separate process controller 4 and temperature controller 8 of FIG. 2*a.* The integrated controller 10 includes a processor (not shown) having code for predicting the phase composition of the alloy in execution thereon. Memory means (not shown) in communication with the processor is provided for storing calculated phase composition data therein.

Figure 2C:
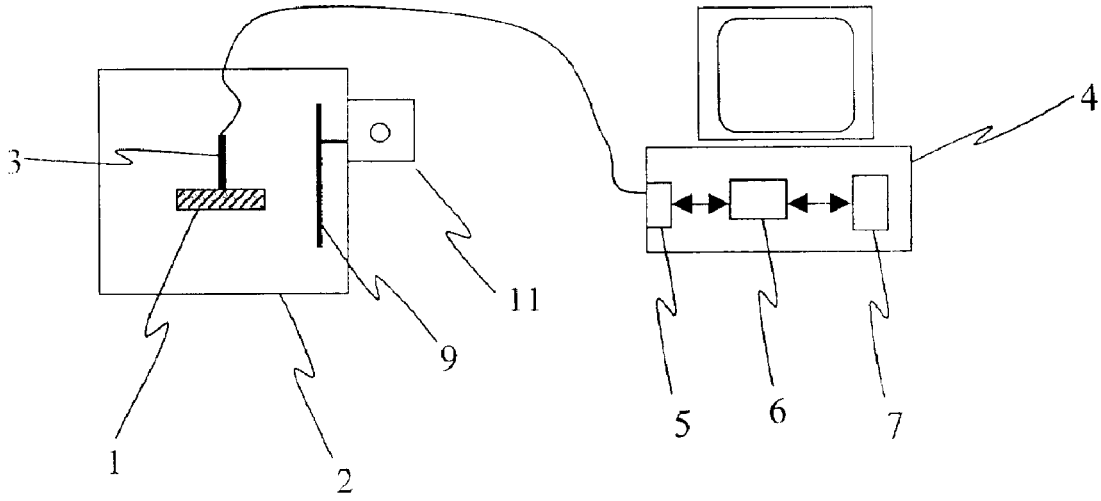
FIG. 2*c* shows a system for optimizing the heat treatment conditions of a precipitation-hardenable aluminum alloy according to a third preferred embodiment of the instant invention.

Referring to FIG. 2*c,* shown is a system for optimizing the conditions of heat treatment of a precipitation-hardenable aluminum alloy according to a third preferred embodiment of the instant invention. Drawing elements identical to those previously described with reference to FIG. 2*a* are assigned like reference numerals in FIG. 2*c.* In the third preferred embodiment, the sample 1 is accommodated within an oven 2 which is preheated to a predetermined temperature, for instance by setting a thermostat 11 of the oven 2. A thermocouple 3 is provided for sensing, in real-time, the temperature of the sample 1 and for providing a signal in dependence upon the sensed temperature to a processor 6 of a process controller, such as for instance a personal computer 4, via an input/output port 5. In use, the processor 6 has code for predicting the phase composition of the alloy in execution thereon. The code utilizes a series of predetermined rate equations and initial conditions to process the real-time temperature data and to predict the instantaneous precipitation state of the alloy. The processor 6 is also in communication with the memory storage area 7 for storing calculated phase composition data therein. In basic terms, the calculated volume fraction of each phase within the alloy component is updated in an iterative fashion at predetermined time intervals during the thermal treatment of the component. When a predetermined phase composition is predicted, the processor 6 provides a signal indicative of a desired result being attained, and the sample 1 is removed from the oven 2 by one of automated and manual means (not shown). Optionally, the composition of atmosphere surrounding the sample 1 is controllable, for instance the oven 2 includes means for flowing an inert gas therethrough such as to prevent unwanted reactions occurring at the surface of the alloy being treated therein.

Figure 3:
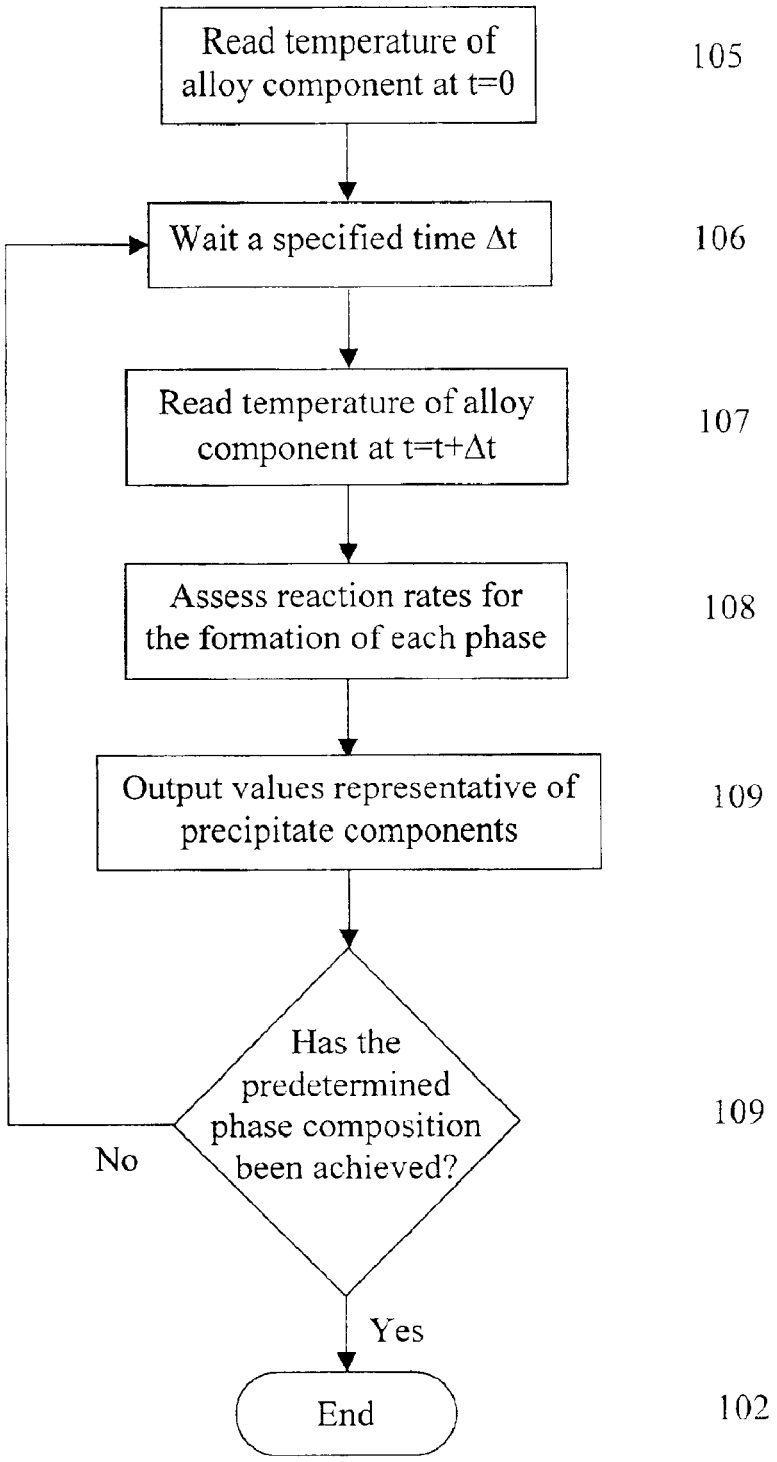
FIG. 3 shows a simplified flow diagram of a method for optimizing the heat treatment conditions of a precipitation-hardenable aluminum alloy according to the instant invention.

Referring to FIG. 3, shown is a simplified flow diagram of a method for optimizing the heat treatment conditions of a precipitation-hardenable aluminum alloy, according to the instant invention. At step 105 the absolute temperature T of the alloy component is sensed at the beginning t=0 of a preprogrammed temperature program, where T is the temperature of the component as measured using a thermocouple attached directly thereto and t is a time maintained by a local clock, such as for instance a real-time clock of the processor 6. For RRA treatment, the alloy component preferably is in the T6 temper state at step 105. A predetermined time period Δt is introduced at step 106, during which time the heat treatment of the alloy component continues according to the temperature program. At step 107, a temperature of the alloy component is sensed at time t=t+Δt and a signal is provided to the processor 6 in dependence upon the sensed temperature. At step 108 the reaction rates for the formation of each precipitate phase are assessed and at optional step 109 a series of values representative of a current precipitate phase composition of the alloy is provided as output to a suitable information display device. At decision step 110 the current precipitate phase composition is compared by the processor 6 to a predetermined threshold precipitate phase composition. If the current composition is substantially identical to the predetermined threshold composition, the processor 6 sends a signal to the temperature controller 8 to terminate the temperature program. The method terminates at step 102. Optionally, the processor 6 sends a signal to the temperature controller 8 to otherwise affect the temperature program. Alternatively, when the current composition differs substantially from the predetermined threshold composition, steps 106–110 are repeated, wherein the phase composition is updated in an iterative fashion during each cycle.

Figure 4:
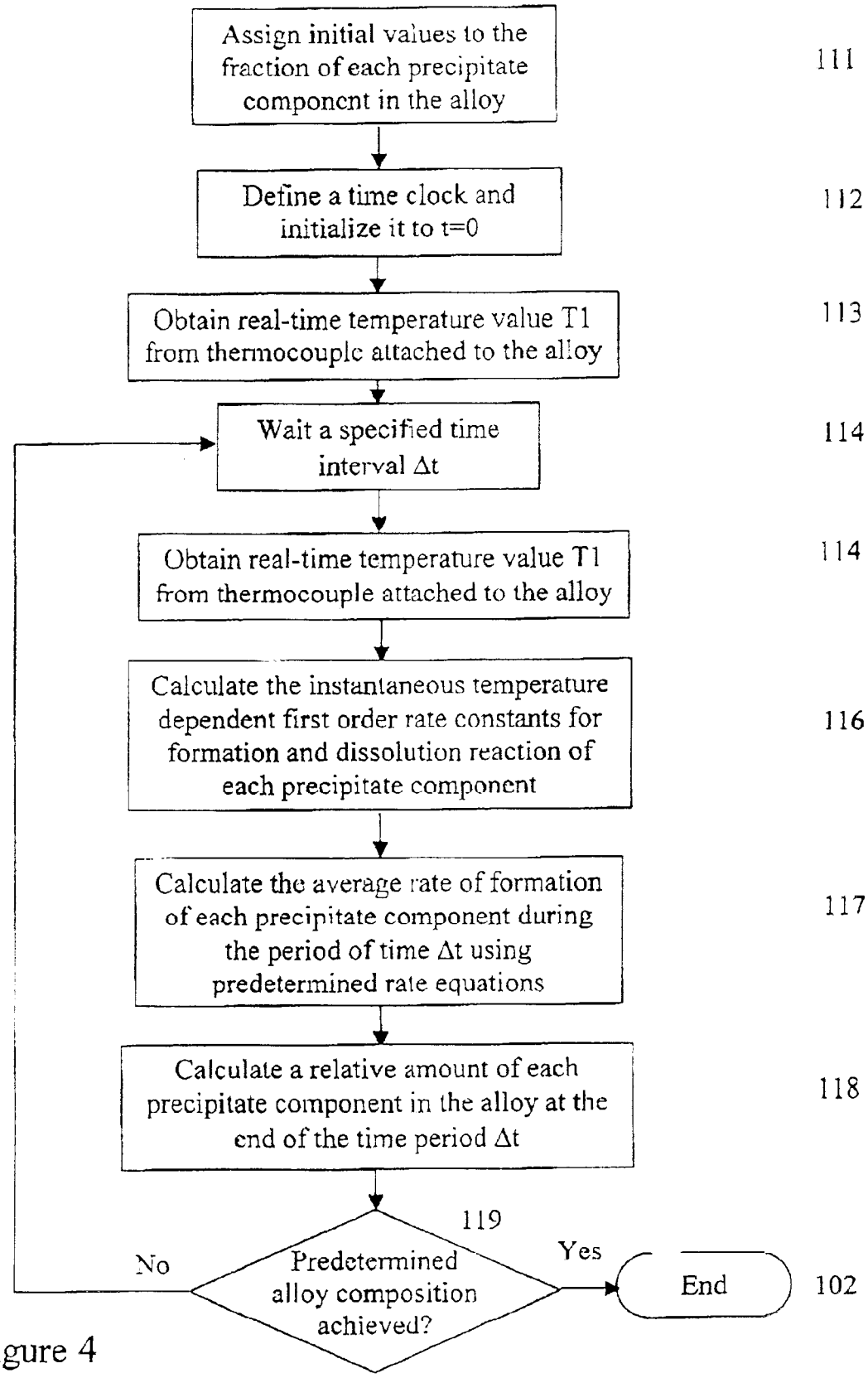
FIG. 4 shows a simplified flow diagram of a method for assessing temperature effects on precipitation-hardenable aluminum alloys according to the instant invention.

Referring to FIG. 4, shown is a simplified flow diagram of a method for assessing the effects of temperature on a precipitation-hardenable aluminum alloy, according to the instant invention. The method of FIG. 4 will now be disclosed by way of an example in which a precipitation hardenable 7075 aluminum alloy is considered. It is to be understood, however, that the instant example is intended to be illustrative only, and is in not to be considered limiting in any way. At step 111 a set of initial values are provided in dependence upon the identity of the instant aluminum alloy. At step 112 a time clock is defined and initialized to t=0. At step 113 the absolute temperature T of the alloy component is provided at the beginning t=0 of the temperature program, where T is the temperature of the component as measured using a thermocouple attached directly thereto. At step 114 a predetermined time period Δt is introduced, during which time the heat treatment of the alloy component continues according to the temperature program. At step 115, a current temperature of the alloy component is determined at time t=t+Δt and a signal is provided to the processor 6 in dependence upon the current temperature. At step 116 a series of instantaneous temperature dependent first order rate equations are determined for the formation $k_{i,f}$ and the dissolution $k_{i,d}$ reactions according to equations 1–6

$$K_{1,f}=(2.084\times10^{10}*T)e^{(-114400/RT)} \quad (1)$$

$$K_{1,d}=(2.084\times10^{10}*T)e^{(-(106000-T*(R-77\ 8))/RT)} \quad (2)$$

$$K_{2,f}=(2.084\times10^{10}*T)e^{(-143800/RT)} \quad (3)$$

$$K_{2,d}=(2.084\times10^{10}*T)e^{(-149000/RT)} \quad (4)$$

$$K_{3,f}=(2.084\times10^{10}*T)e^{(-158500/RT)} \quad (5)$$

$$K_{3,d}=(2.084\times10^{10}*T)e^{(-63100-T*(R-221\ 5))/RT)} \quad (6)$$

Wherein the pre-exponential factor $2.084\times10^{10}$ is a value obtained by dividing the Boltzmann constant k by Planck's constant h, and the exponential term is an initial value provided in dependence upon the composition of the alloy and which includes a value indicative of an activation energy for a particular reaction step.

At step 117 the rates of formation g[i] for each precipitate component are calculated. For instance, predetermined rate equations for predicting the rates of formation g[i] of each known precipitation phase, i, of the alloy are represented in code for execution on the processor 6. The alloy dependent initial condition values are incorporated into the executable code. Optionally, the alloy dependent initial values are read from a database of values once the code is in execution on the processor 6. The alloy dependent initial values include a series of threshold temperatures, one threshold temperature $T_i$ for each precipitate phase. When the temperature that is sensed by the thermocouple 3 exceeds the threshold temperature $T_i$ for a particular precipitate phase, the rate of formation of that precipitate phase is determined according to a first rate equation. Alternatively, when the temperature that is sensed by the thermocouple 3 is below the threshold temperature $T_i$ for a particular precipitate phase, the rate of formation of that precipitate phase is determined according to a second rate equation.

In the case of a precipitation hardenable 7075 aluminum alloy the known precipitate phases are Guinier-Preston (G-P) zones, η', η, which are herein represented by i=1, 2 and 3, respectively. Thus, g[i] represents the rate of formation of G-P zones and $T_i$ is the predetermined threshold temperature for the G-P zone phase. Then the rates of formation g[i] of each phase, expressed in terms of the rate of change of the volume fraction of each phase, are calculated according to the following equations:

Is $T>T_3=425°$ C.?

If yes then $g[3]=-k_{3,d}*f[3]_0$ [7]

If no then $g[3]=k_{3,f}(1-f[3]_0)-k_{3,d}*f[3]_0$ [8]

$T>T_2=300°$ C.?

If yes then $g[2]=-k_{2,d}*f[2]_0$ [9]

If no then $g[2]=k_{2,f}(1-f[2]_0-f[3]_0)-k_{2,d}*f[2]_0$ [10]

$T>T_3=140°$ C.?

If yes then $g[1]=-k_{3,d}*f[1]_0$ [11]

If no then $g[1]=k_{1,f}(1-f[1]_0-f[2]_0-f[3]_0)-k_{1,d}*f[1]_0$ [12]

Wherein $f[1]_0$, $f[2]_0$ and $f[3]_0$ are the volume fraction of G-P zones, η' and η at the beginning of the time period Δt.

At step 118 a current volume fraction of each precipitate component is calculated according to equations 13–14:

1. $f[3]=f[3]_0+g[3]*\Delta t$ [13]

2. $f[2]=f[2]_0+g[2]*\Delta t$ [14]

3. $f[1]=f[1]_0+g[1]*\Delta t$ [15]

At decision step 119 the current phase composition of the alloy is compared to a predetermined phase composition. If the current phase composition is within the predetermined limits, then the method is terminated at step 120. Alternatively, steps 114–119 are repeated until the current phase composition is within the predetermined limits.

A pseudo-code programming tool for developing an algorithm according to the instant invention is presented below:

1. Create two one-dimensional arrays, each having three elements: f[3] represent three precipitate components and g[3] represent three reaction rates in 7075.
2. Assign initial values to the precipitate components as: f[1]=0.95, f[2]=0.05, f[3]=0.0.
3. Define a universal constant: R=8.31.
4. Define a time clock and initialize it to zero: t=0.
5. Read temperature and time data:
   T1-temperature, ° C.;
   dt-time interval (5 sec) between the current and the last time of reading, sec.
6. Calculate the following variables as defined:

$T=T1+273$: absolute temperature $K1f=(2.084E10*T)*\exp(-114400/RT)$: 1st formation rate $K1d=(2.084E10*T)*\exp(-(106000-T*(R-77.8))/RT)$: 1st dissolution rate $K2f=(2.084E10*T)*\exp(-143800/RT)$: $2^{nd}$ formation rate $K2d=(2.084E10*T)*\exp(-149000/RT)$: $2^{nd}$ dissolution rate $K3f=(2.084E10*T)*\exp(-158500/RT)$: 3rd formation rate $K3d(2.084E10*T)*\exp(-(63100-T*(R-221.5))/RT)$: 3rd dissolution rate 7. Update the clock: t=t+dt.
8. Check if the condition TI>425° C. is met.

If YES, calculate the third reaction rate as: $g[3]=-K3d*f[3]$.

If NO, calculate the third reaction rate as $g[3]=K3f*(1-f[3])-K3d*f[3]$

9. Calculate the amount of the $3^{rd}$ precipitation component as: f[3]=f[3]+g[3]*dt 10. Check if the condition TI>300° is met.

If YES, calculate the second reaction rate as $g[2]=-K2d*f[2]$.

If NO, calculate the second reaction rate as: $g[2]=K2f*(1-f[2]-f[3])-K2d*f[2]$

11. Calculate the amount of the $2^{nd}$ precipitation component as f[2]=f[2]+g[2]*dt 12. Check if the condition TI>140° is met.

If YES, calculate the first reaction rate as $g[1]=-K1d*f[1]$.

If NO, calculate the first reaction rate as: $g[1]=K1f*(1-f[1]-f[2]-f[3])-K1d*f[1]$ 13. Calculate the amount of the $1^{st}$ precipitation component as f[1]=f[1]+g[1]*dt 14. Output f[1], f[2] and f[3]
15. Check (1) if f[2]>0.71 and (2) if f[3]>0.041, whichever is met first; if FALSE, reiterate steps 5 to 15; if TRUE, STOP.

The actual code for execution on the processor 6 is developed using an appropriate computer coding language, such as for instance a machine code language selected from the group including: C++ and Visual C++. Of course, other computer coding languages are used optionally, for instance a coding language selected in dependence upon the operating system of the processor 6.

It is an advantage of the instant invention that optimized heat treatment condition are determined in real time and in dependence upon the predicted properties of an alloy component being treated. Further, post-treatment testing to determine the characteristics of the processed component is unnecessary because the precipitate phase composition of the alloy, and therefore the strength and corrosion resistance properties of the alloy, is known.

Further advantageously, the instant invention is useful for predicting heat-induced damage to components of in service aircraft. The ability to predict and assess damage to a component prior to an actual failure of component allows the operator of the aircraft an opportunity to carry out an appropriate maintenance program or to replace the damaged component. Significantly, conventional heat damage assessment methods using hardness-electrical conductivity correlations are unable to determine the material state, since the harness versus conductivity relationships in precipitation hardenable aluminum alloys often exhibit loop curves. As such, the method for predicting precipitation kinetics in precipitation-hardenable alloys according to the present invention provides a valuable and practical diagnostic tool for aircraft operators and engineers.

Numerous other embodiments may be envisaged without departing from the spirit or scope of the invention.

What is claimed is:

1. A method for providing improved heat treatment conditions for a precipitation hardenable alloy comprising:

a) affecting the temperature of the alloy to change an amount of a first precipitate phase relative to an amount of a second precipitate phase;

b) sensing an instantaneous temperature of the alloy and providing a signal in dependence thereof;

c) calculating a value indicative of a current precipitate-phase composition of the alloy according to a series of predetermined rate equations and in dependence upon the provided signal;

d) comparing the calculated value to a predetermined threshold value; and, e) affecting the alloy in dependence upon a result of the step of comparing, wherein the predetermined threshold value is characteristic of an alloy having at least one of an indicated yield strength, specific conductivity and corrosion property.

2. A method for providing improved heat treatment conditions according to claim 1 wherein a) comprises:

a1) providing the alloy within an atmosphere for heat treatment;

a2) changing the temperature of the atmosphere according to a predetermined temperature program; and, a3) waiting for the temperature of the alloy to change.

3. A method for providing improved heat treatment conditions according to claim 2 wherein e) includes when the calculated value exceeds the predetermined threshold value, ending the predetermined temperature program.

4. A method for providing improved heat treatment conditions according to claim 2 wherein e) includes when the calculated value exceeds the predetermined threshold value, removing the alloy from the atmosphere for heat treatment.

5. A method for providing improved heat treatment conditions according to claim 2 wherein e) includes when the calculated value exceeds the predetermined threshold value, changing further the temperature of the atmosphere according to a second predetermined temperature program.

6. A method for providing improved heat treatment conditions according to claim 1 wherein a) comprises:

a1) providing the alloy within an atmosphere for heat treatment; and, a2) waiting for the temperature of the alloy to change.

7. A method for providing improved heat treatment conditions according to claim 6 wherein e) includes when the calculated value exceeds the predetermined threshold value, removing the alloy from the atmosphere for heat treatment.

8. A method for providing improved heat treatment conditions according to claim 1 wherein the signal is provided in real-time.

9. A method for providing improved heat treatment conditions according to claim 1 wherein the chemical composition of the atmosphere for heat treatment is variably controllable.

10. A method for predicting precipitation kinetics in precipitation-hardenable alloys comprising:

a) providing an initial value in dependence upon first and second inter-convertible precipitate phases of the alloy;

b) providing data indicative of thermal exposure of the alloy;

c) Calculating a value according to predetermined rate equations in dependence upon the provided initial value and the provided data;

d) determining a value indicative of a current precipitate-phase composition of the alloy in dependence upon the calculated value; and, e) affecting the alloy in dependence upon a result of the step of determining.

11. A method for predicting precipitation kinetics in precipitation-hardenable alloys according to claim 10 wherein the provided initial value comprises a value indicative of an initial precipitate-phase composition of the alloy.

12. A method for predicting precipitation kinetics in precipitation-hardenable alloys according to claim 11 wherein the provided data is a real-time temperature sensed by a sensor in thermal communication with the alloy.

13. A method for predicting precipitation kinetics in precipitation-hardenable alloys according to claim 11 wherein the provided data is a simulated thermal exposure history of the alloy.

14. A system for providing improved process control for heat treating a precipitation-hardenable alloy comprising:

a holder for accommodating a sample of the precipitation-hardenable alloy, the alloy having first and second inter-convertible precipitate phases;

a temperature controller for affecting the temperature of the sample;

a sensor in communication with the sample for providing a signal in dependence upon a sensed temperature of the sample; and, a processor for executing code thereon to calculate a value in dependence upon the signal and according to a series of predetermined rate equations, the value indicative of a current precipitate phase composition of the sample, and for comparing the calculated value to a predetermined threshold value.

15. A system according to claim 14 including a feed back controller responsive to the processor for affecting a characteristic of the process.

16. A system according to claim 15 wherein the feed back controller is for affecting a temperature of the precipitation-hardenable alloy.

* * * * *